US007223507B2

(12) United States Patent
Ioannidis et al.

(10) Patent No.: US 7,223,507 B2
(45) **Date of Patent: *May 29, 2007**

(54) IMAGING MEMBERS

(75) Inventors: Andronique Ioannidis, Webster, NY (US); Nancy L. Belknap, Rochester, NY (US); Cindy C. Chen, Rochester, NY (US); Lanhui Zhang, Penfield, NY (US); Timothy P. Bender, Port Credit (CA); John F. Graham, Oakville (CA); Ah-Mee Hor, Mississauga (CA); James M. Duff, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,204

(22) Filed: Apr. 4, 2003

(65) Prior Publication Data

US 2004/0197685 A1 Oct. 7, 2004

(51) Int. Cl.
*G03G 5/00* (2006.01)

(52) U.S. Cl. ..... 430/73; 430/56; 430/78

(58) Field of Classification Search ..... 430/56, 430/72, 75, 76, 73, 900, 78
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,992,349 | A * | 2/1991 | Chen et al. | 430/58.5 |
| 5,232,800 | A | 8/1993 | Pavlisko et al. | |
| 5,336,577 | A | 8/1994 | Spiewak et al. | 430/59 |
| 5,994,012 | A * | 11/1999 | Watanabe et al. | 430/58.25 |
| 6,485,873 | B1 * | 11/2002 | Ohkura et al. | 430/72 |
| 2004/0096761 | A1 * | 5/2004 | Lin et al. | 430/96 |

FOREIGN PATENT DOCUMENTS

| | | | |
|---|---|---|---|
| EP | 0 710 892 | A1 | 5/1996 |
| JP | 60102640 | | 6/1985 |
| JP | 2000019758 | A * | 1/2000 |
| JP | 2002055472 | A * | 2/2002 |

OTHER PUBLICATIONS

Borsenberger, Paul. M et al. Organic Photoreceptors for Imaging Systems. New York: Marcel_Dekker, Inc. (1993) pp. 190-195.*
Diamond et al. Handbook of Imaging Materials, 2nd edition. New York: Marcel-Dekker, Inc. (2002) pp. 370-381.*
Diamond, Arthur S & David Weiss (eds.) Handbook of Imaging Materials. New York: Marcel-Dekker, Inc. (Nov. 2001) pp. 388-395.*
Dasarao K. Murti et al., "Photoconductive Members", filed Apr. 30, 1999, U.S. Appl. No. 09/302,524.
Liang-Bih Lin et al., "Imaging Members", filed May 10, 2002, U.S. Appl. No. 10/144,147.
James M Duff et al., "Benzophenone Bisimide Malononitrile Derivatives", filed Aug. 20, 2002, U.S. Appl. No. 10/225,402.
EP Search Report in European Patent Application No. 04008236.4.

* cited by examiner

*Primary Examiner*—Christopher Rodee
(74) *Attorney, Agent, or Firm*—Eugene O. Palazzo; Fay Sharpe LLP

(57) ABSTRACT

A photoconductive imaging member comprised of a supporting substrate, and thereover a single layer comprised of a mixture of a photogenerator component, charge transport components, and a certain electron transport component, and a certain polymer binder.

25 Claims, No Drawings

IMAGING MEMBERS

RELATED PATENT APPLICATIONS

Illustrated in copending application U.S. Ser. No. 10/225,402, filed Aug. 20, 2002 on Benzophenone Bisimide Malononitrile Derivatives, the disclosure of which is totally incorporated herein by reference, is, for example, a compound having the Formula I

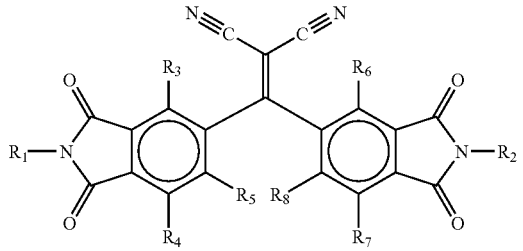

wherein:

$R_1$ and $R_2$ are independently selected from the group consisting of hydrogen, a hetero atom containing group and a hydrocarbon group that is optionally substituted at least once with a hetero atom moiety; and $R_3$, $R_4$, $R_5$, $R_6$, $R_7$, and $R_8$ are independently selected from the group consisting of a nitrogen containing group, a sulfur containing group, a hydroxyl group, a silicon containing group, hydrogen, a halogen, a hetero atom containing group and a hydrocarbon group that is optionally substituted at least once with a hetero atom moiety.

Illustrated in copending application U.S. Ser. No. 10/144,147, filed May 10, 2002 on Imaging Members, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component can be a metal free phthalocyanine.

Illustrated in copending application U.S. Ser. No. 09/302,524, filed on Apr. 30, 1999 on Photoconductive Members, the disclosure of which is totally incorporated herein by reference, is, for example, an ambipolar photoconductive imaging member comprised of a supporting substrate, and thereover a layer comprised of a photogenerator hydroxygallium component, a charge transport component, and an electron transport component.

Illustrated in copending application U.S. Ser. No. 09/627,283, filed Jul. 28, 2000 on Imaging Members Having a Single Electrophotographic Photoconductive Insulating Layer, the disclosure of which is totally incorporated herein by reference, is, for example, an imaging member comprising a member comprising a supporting layer and a single electrophotographic photoconductive insulating layer, the electrophotographic photoconductive insulating layer comprising particles comprising Type V hydroxygallium phthalocyanine dispersed in a matrix comprising an arylamine hole transporter and an electron transporter selected from the group consisting of N,N'-bis(1,2-dimethylpropyl)-1,4,5,8-naphthalenetetracarboxylic diimide represented by the following structural formula:

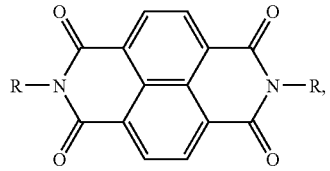

1,1'-dioxo-2-(4-methylphenyl)-6-phenyl-4-(dicyanomethylidene)thiopyran represented by the following structural formula:

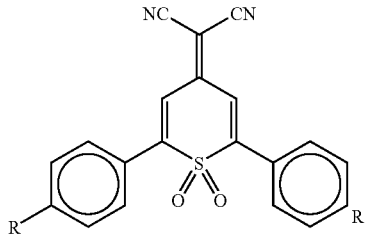

wherein each R is independently selected from the group consisting of hydrogen, alkyl with 1 to 4 carbon atoms, alkoxy with 1 to 4 carbon atoms and halogen and a quinone selected from the group consisting of:

carboxybenzylhaphthaquinone represented by the following structural formula:

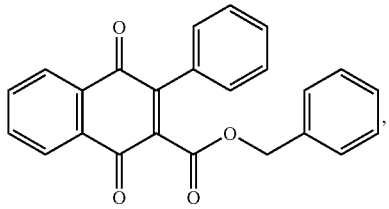

, and tetra (t-butyl) diphenoquinone represented by the following structural formula:

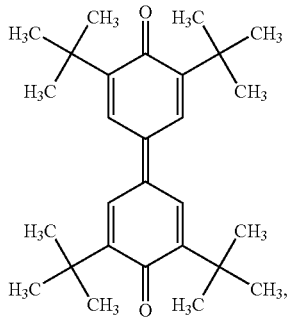

, and mixtures thereof, and a film forming binder.

The appropriate components and processes of the above copending applications may be selected for the invention of the present application in embodiments thereof.

BACKGROUND

This invention relates in general to electrophotographic imaging members, and more specifically, to positively and negatively, preferably positively charged electrophotographic imaging members with a single electrophotographic photoconductive insulating layer and processes for forming images on the member. More specifically, the present invention relates to a single layered photoconductive imaging member useful in electrostatic digital, including color, process, and which members contain a charge generation layer or photogenerating layer comprised of a photogenerating component, such as a photogenerating pigment, dispersed in a matrix of a hole transporting and an electron transporting binder, and in embodiments a protective overcoat, such as a polymer layer. The electrophotographic imaging member layer components, which can be dispersed in various suitable resin binders, can be of various thicknesses, however, in embodiments a thick layer, such as from about 5 to about 60, and more specifically, from about 10 to about 40 microns, and yet more specifically, from about 15 to about 40 microns, is selected. This layer can be considered a dual function layer since it can generate charge and transport charge over a wide distance, such as a distance of at least about 50 microns. Also, the presence of the electron transport components in the photogenerating layer can enhance electron mobility and thus enable a thicker photogenerating layer, and which thick layers can be more easily coated than a thin layer, such as about 1 to about 2 microns thick.

The expression "single electrophotographic photoconductive insulating layer" refers in embodiments to a single electrophotographically active photogenerating layer capable of retaining an electrostatic charge in the dark during electrostatic charging, imagewise exposure and image development. Thus, unlike a single electrophotographic photoconductive insulating layer photoreceptor, a multi-layered photoreceptor has at least two electrophotographically active layers, namely at least one charge generating layer and at least one separate charge transport layer.

A number of known electrophotographic imaging members are comprised of a plurality of other layers such as a charge generating layer and a charge transport layer. These multi-layered imaging members in some instances also can contain a charge blocking layer and an adhesive layer between the substrate and the charge generating layer. Further, an anti-plywood layer may be included in the imaging member. Complex equipment and valuable factory floor space are usually needed to manufacture multi-layered imaging members. In addition to presenting plywooding problems, multi-layered imaging members often encounter charge spreading which degrades image resolution. The anti-plywood layer can be a separate layer or be part of a dual function layer. An example of a dual function layer for preventing plywooding is the use of a charge blocking layer or an adhesive layer. The expression "plywood" refers, for example, to the formation of unwanted patterns in electrostatic latent images caused by multiple reflections during laser exposure of a charged imaging member. When developed, these patterns resemble plywood. Multi-layered imaging members are also costly and time consuming to fabricate because of the many layers that need to be formed.

Another problem encountered with multilayered photoreceptors comprising a charge generating layer and a charge transport layer is that the thickness of the charge transport layer, which is normally the outermost layer, tends to become thinner due to wear during image cycling. The change in thickness can cause changes in the photoelectrical properties of the photoreceptor. Thus, to maintain image quality, complex and sophisticated electronic equipment and software management are usually encountered in the imaging machine to compensate for the photoelectrical changes, which can increase the complexity of the machine, the cost of the machine, the size of the footprint occupied by the machine, and the like. Without proper compensation of the changing electrical properties of the photoreceptor during cycling, the quality of the images formed can degrade because of spreading of the charge pattern on the surface of the imaging member and a decline in image resolution. High quality images can be important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

Attempts have been made to fabricate electrophotographic imaging members comprising a substrate and a single electrophotographic photoconductive insulating layer in place of a plurality of layers such as a charge generating layer and a charge transport layer. However, in formulating single electrophotographic photoconductive insulating layer photoreceptors many problems need to be overcome including acceptable charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings. Also, compatibility among pigment, hole and electron transport molecules, and film forming binder is desirable.

REFERENCES

U.S. Pat. No. 4,265,990, the disclosure of which is totally incorporated herein by reference, illustrates a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This member may be imaged in the conventional xerographic mode which usually includes charging, exposure to light and development.

U.S. Pat. No. 5,336,577, the disclosure of which is totally incorporated herein by reference, illustrates a thick organic ambipolar layer on a photoresponsive device, and which device is simultaneously capable of charge generation and charge transport. In particular, the organic photoresponsive layer contains an electron transport material, such as a fluorenylidene malononitrile derivative, and a hole transport material, such as a dihydroxy tetraphenyl benzadine containing polymer.

SUMMARY

It is, therefore, a feature of the present invention to provide electrophotographic imaging members comprising a single electrophotographic photoconductive insulating layer.

It is another feature of the present invention to provide an improved electrophotographic imaging member comprised of a single electrophotographic photoconductive insulating layer that avoids plywooding problems, and which layer contains a photogenerating pigment, an electron transport component, a hole transport component, and a film forming binder.

It is still another feature of the present invention to provide an improved electrophotographic imaging member comprising a single electrophotographic photoconductive insulating layer that eliminates the need for a charge blocking layer between a supporting substrate and an electrophotographic photoconductive insulating layer, and wherein the single layer photogenerating mixture layer can be of a thickness of, for example, from about 5 to about 60 microns, and which members possess excellent high photosensitivities, acceptable discharge characteristics, improved dark decay, that is for example a decrease in the dark decay as compared to a number of similar prior art members, and further which members are visible and infrared laser compatible.

It is yet another feature of the present invention to provide an electrophotographic imaging member comprising a single electrophotographic photoconductive insulating layer which can be fabricated with fewer coating sequences at reduced cost.

It is another feature of the present invention to provide an electrophotographic imaging member comprising a single electrophotographic layer which eliminates/minimized charge spreading, and possesses reduced dark decay characteristics, therefore, enabling higher resolution, and which members are not substantially susceptible to plywooding effects, light refraction problems, and thus with the photoconductive imaging members of the present invention in embodiments thereof an undercoated separate layer is avoided.

It is yet another feature of the present invention to provide an improved electrophotographic imaging member comprising a single layer which has improved cycling and stability, and which member possesses high resolution since, for example, the image forming charge packet may not need to traverse the entire thickness of the member and thus may not spread in area, and further with such singled layered members there are enabled in embodiments extended life high resolution members since, for example, the layer can be present in a thicker layer, such as from about 5 to about 60 microns, as compared to a number of multilayered devices wherein the thickness of the photogenerator layer is usually about 1 to about 3 microns in thickness, thus with the aforementioned invention devices there is substantially no image resolution loss and substantially no image resolution loss with wear.

It is still yet another feature of the present invention to provide an improved electrophotographic imaging member comprising a single electrophotographic photoconductive insulating layer for which PIDC curves do not substantially change with time or repeated use, and also wherein with these photoreceptors charge injections from the substrate to the photogenerating pigment are reduced and thus a charge blocking layer can be avoided.

It is still another feature of the present invention to provide an improved electrophotographic imaging member comprising a single electrophotographic photoconductive insulating layer which is ambipolar and can be operated at either a positive (the preferred mode) or a negative bias.

The present invention in embodiments thereof is directed to a photoconductive imaging member comprised of a supporting substrate, a single layer thereover comprised of a mixture of a photogenerating pigment or pigments, a hole transport component or components, an electron transport component or components, and a binder. More specifically, the present invention relates to an imaging member with a thick, such as for example, from about 5 to about 60 microns, single active layer comprised of a mixture of photogenerating pigments, hole transport molecules, electron transport compounds, and a binder.

Aspects of the present invention are directed to a photoconductive imaging member comprised in sequence of a substrate, a single electrophotographic photoconductive insulating layer, the electrophotographic photoconductive insulating layer comprising photogenerating particles comprising photogenerating pigments, such as metal free phthalocyanines, hydroxy gallium phthalocyanines, chlorogallium phthalocyanines, titanyl phthalocyanines, perylenes, mixtures thereof, and the like, dispersed in a matrix comprising hole transport molecules such as, for example, arylamines, like N,N'-bis-(3,4-dimethylphenyl)-4,4'-biphenyl amine (Ae-18), N,N'-bis-(4-methylphenyl)-N,N'-bis(4-ethylphenyl)-1,1'-3,3'-dimethylbiphenyl)-4,4'-diamine (Ae-16), and the like, and an electron transport material, for example, selected from the group consisting of N,N'-bis(2,2-dimethylpropyl)-1,4,5,8-naphthalenetetracarboxylic diimide, (NTDI), substituted NTDI, butoxy carbonyl fluorenylidene malononitrile; 2-EHCFM, a higher solubility BCFM, mixtures thereof, and the like; a photoconductive imaging member comprised of a supporting substrate, and thereover a single layer comprised of a mixture of a photogenerator component, a charge transport component, an electron transport component, and a polymer binder, and wherein the charge transport component is selected from the group consisting of N,N'-bis-(3,4-dimethylphenyl)-4-biphenyl amine; N,N'-bis-(4-methylphenyl)-N,N'-bis-(4-ethylphenyl)-1,1',3,3'-dimethylbiphenyl)-4,4'-diamine; N,N'-diphenyl-N,N'-bis(alkylphenyl)-1,1-biphenyl-4,4'-diamine; and tri-p-tolylamine; and wherein the electron transport component is selected from the group consisting of a carbonylfluorenone malononitrile of the formula

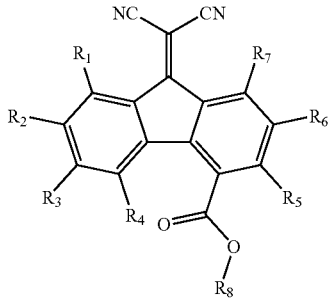

wherein each R is independently selected from the group consisting of hydrogen, alkyl, alkoxy, aryl, and halide; a nitrated fluorenone of the formula

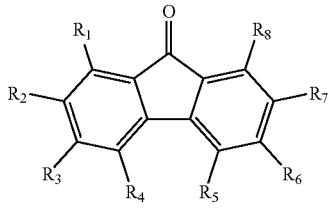

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

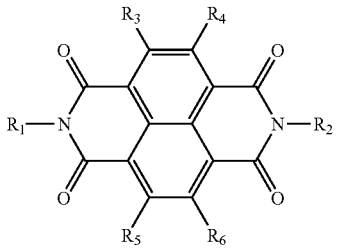

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1dioxo-2-(aryl)-6-phenyl-4-(dicyanomethylidene)thiopyran of the formula

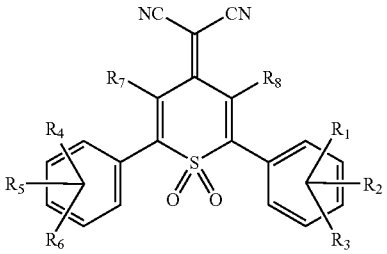

wherein each R is independently selected from the group consisting of hydrogen, alkyl, alkoxy, aryl, and halide; a carboxybenzylnaphthaquinone of the alternative formulas

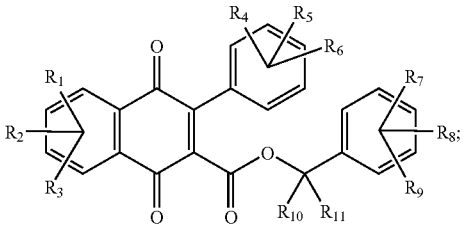

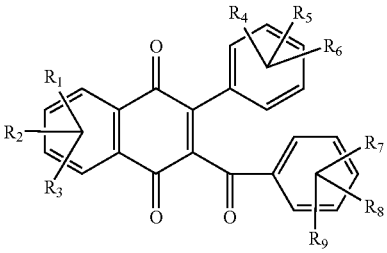

wherein each R is independently selected from the group consisting of hydrogen, alkyl, alkoxy, aryl, and halide; and a diphenoquinone of the formula

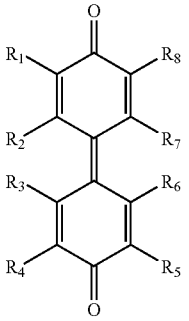

wherein each R is independently selected from the group consisting of hydrogen, alkyl, alkoxy, aryl, and halide; photoconductive imaging members comprised of supporting substrate, and thereover a layer comprised of a mixture of a photogenerator pigment, certain hole transport components, and certain electron transport components; a member wherein the single layer positively charged photoconductive member is of a thickness of from about 5 to about 60 microns, and wherein there is enabled high photosensitivity, efficient charge generation, acceptable insulating properties while the member is in a dark environment with no light, or little light, substantially high leakage resistance, excellent dark decay characteristics, and more specifically, low dark decay as illustrated herein; a member wherein the amounts for each of the components in the single layer mixture is from about 0.05 weight percent to about 25 weight percent for the photogenerating component, from about 20 weight percent to about 65 weight percent for the hole transport component, and from about 10 weight percent to about 70 weight percent for the electron transport component, and wherein the total of the components is about 100 percent, and wherein the layer is dispersed in from about 10 weight percent to about 75 weight percent of a polymer binder; a member wherein the single layer mixture amounts for each of the components is from about 0.5 weight percent to about 5 weight percent for the photogenerating component; from about 30 weight percent to about 55 weight percent for the charge transport component; and from about 5 weight percent to about 25 weight percent for the electron transport component; and which components are contained in from about 30 weight percent to about 50 weight percent of a polymer binder; a member wherein the thickness of the single photogenerating layer mixture is from about 10 to about 40 microns; a member wherein the binder is present in an amount of from about 40 to about 90 percent by weight, and wherein the total of all components of the photogenerating component, the hole transport component, the binder, and the electron transport component is 100 percent; a member wherein there is selected as the photogenerating pigment a metal free phthalocyanine that absorbs light of a wavelength of from about 550 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder for the single photogenerating mixture layer is selected from the group consisting of polyesters, polyvinyl butyrals, polycarbonates, polystyrene-b-polyvinyl pyridine, polyvinyl formulas; PCZ polycarbonates; and the like; an imaging member wherein the hole transport in the photogenerating mixture comprises aryl amine molecules; an imaging member wherein the electron transport component is BCFM, (4-n-butoxycarbonyl-9-fluorenylidene)malononitrile, 2-methylthioethyl 9-dicyano methylenefluorene-4-carboxylate, 2-(3-thienyl)ethyl 9-dicyanomethylene fluorene-4-carboxylate, 2-phenylthioethyl 9-dicyanomethylenefluorene-4-carboxylate, or 11,11,12,12-tetracyano anthraquinodimethane; an imaging member wherein the photogenerating component is a metal free phthalocyanine; an imaging member wherein the photogenerating component is a metal phthalocyanine; the electron transport is NTDI, BCFM, and the charge transport is a hole transport of N,N'-diphenyl-N,N-bis(3-methyl phenyl)-1,1'-biphenyl-4,4'-diamine molecules; an imaging member wherein the X polymorph metal free phthalocyanine selected as a photogenerating pigment has major peaks, as measured with an X-ray diffractometer, at Bragg angles (2 theta+/−0.2°); an imaging member wherein the photogenerating component mixture layer further contains a second photogenerating pigment; an imaging member wherein the photogenerating mixture layer contains a perylene; an imaging member wherein the photogenerating component is comprised of a mixture of a metal free phthalocyanine, and a second photogenerating pigment; a method of imaging which comprises generating an electrostatic latent image on the imaging member, developing the latent image, and transferring the developed electrostatic image to a suitable substrate; a method of imaging wherein the imaging member is exposed to light of a wavelength of from about 500 to about 950 nanometers; an imaging apparatus containing a charging component, a development component, a transfer component, and a fixing component, and wherein the apparatus contains a photoconductive imaging member comprised of supporting substrate, and thereover a layer comprised of a photogenerator component, a charge transport component, and an electron transport component; an imaging member wherein the blocking layer is contained as a coating on a substrate, and wherein the adhesive layer is coated on the blocking layer; and photoconductive imaging members comprised of an optional supporting substrate, a single layer comprised of a photogenerating layer of a phthalocyanine, a BZP perylene, which BZP is preferably comprised of a mixture of bisbenzimidazo(2,1-a-1',2'-b)anthra(2,1,9-def:6,5,10-d'e'f')diisoquinoline-6,1-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference, the charge transport molecules, illustrated herein, certain electron transport components, and a binder polymer. Specifically, for example, the charge transport molecules for the photogenerating mixture layer are aryl amines, and the electron transport is a fluorenylidene, such as (4-n-butoxycarbonyl-9-fluorenylidene)malononitrile, reference U.S. Pat. No. 4,474,865, the disclosure of which is totally incorporated herein by reference.

Specific embodiments illustrated herein relate to a single layer photoconductive imaging member comprised of a photogenerating pigment or pigments, a charge transport, and electron transport, and a polymeric binder; and wherein the pigment or pigments are comprised of x metal free phthalocyanine; trivalent metal phthalocyanines, such as chlorogallium phthalocyanine (ClGaPc); metal phthalocyanines, such as hydroxygallium phthalocyanine (OHGaPc); titanyl phthalocyanine (OTiPC); benzylimidizo perylene (BZP); 535+ dimer wherein the charge transport is comprised of hole transporting molecules of Ae-18; AB-16; N,N'-diphenyl-N,N'-bis-(alkylphenyl)-1,1-biphenyl-4,4' diamine, mixtures thereof, and which mixtures contain, for example, from about 1 to about 99 percent of one hole transport, and from about 99 to about 1 weight percent of a second hole transport and wherein the total thereof is about 100 percent; from about 40 to about 65 percent of one hole transport, and from about 65 to about 40 weight percent of a second hole transport and wherein the total thereof is about 100 percent; from about 30 to about 65 percent of one hole transport, from about 30 to about 65 weight percent of a second hole transport, and from about 30 to about 65 weight percent of a third hole transport and wherein the total thereof is about 100 percent; and yet more specifically, a single or one layer photoconductive member comprised of −40 weight percent of AE-18, 10 weight percent of BCFM, about 47 to about 49 weight percent of a polymer binder, and about 1 to about 3 weight percent of photogenerating pigment, which mixture can be referred to, for example, as the transport matrix; wherein the transport matrix is comprised of 35 weight percent of AE-18, 15 weight percent of NTDI, about 44 to about 48 weight percent of polymer binder, and about 1 to about 4 weight percent of photogenerating pigment and wherein the member contains a supporting substrate layer; wherein the transport matrix is comprised of 35 weight percent of tri-p-tolyamine (TTA), 15 weight percent of BCFM, about 47 to about 49 weight percent of polymer binder, and about 1 to about 3 weight percent of photogenerating pigment; wherein the transport matrix is comprised of 40 weight percent of AE-18, 10 weight percent of 2-EHCFM, ethylhexylcarbonyl fluorenylidene malononitrile, about 47 to about 49 weight percent of polymer binder, and about 1 to about 3 weight percent of photogenerating pigment and wherein the member contains a supporting substrate layer; or wherein the transport matrix is comprised of 40 weight percent of AE-18, 10 weight percent of BIB-CNs, about 47 to about 49 weight percent of polymer binder, and about 1 to about 3 weight percent of photogenerating pigment and wherein the member contains a supporting substrate layer; and wherein the thickness of the member is, for example, from about 15 to about 40 microns.

The single layer photoconductive member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image, and thereafter transferring and fusing the image.

Any suitable effective substrate may be selected for the imaging members of the present invention. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be comprised of a conductive material such as aluminum, chromium, nickel, brass and the like. The substrate may be flexible, seamless or rigid and may have a number of many different configurations, such as, for example, a plate, a drum, a scroll, an endless flexible belt, and the like. In embodiments, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material with the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass or the like. The thickness of the substrate layer as indicated herein depends on many factors, including economical considerations, thus this layer may be of substantial thickness, for example over 3,000 microns, or of a minimum thickness. In one embodiment, the thickness of this layer is from about 75 microns to about 300 microns.

Generally, the thickness of the single layer in contact with the supporting substrate depends on a number of factors, including the thickness of the substrate, and the amount of components contained in the single layer, and the like. Accordingly, this layer can be of a thickness of, for example, from about 3 microns to about 60 microns, more specifically, from about 5 microns to about 30 microns, and yet more specifically, from about 15 to about 35 microns. The maximum thickness of the layer in embodiments is dependent primarily upon factors, such as photosensitivity, electrical properties and mechanical considerations.

The binder resin present in various suitable amounts, for example from about 5 to about 70, more specifically, from about 10 to about 50 weight percent, and yet more specifically from about 47 to about 49 weight percent, may be selected from a number of known polymers such as poly (vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like, and more specifically, bisphenol-Z-carbonate (PCZ), PCZ-500 with a weight average molecular weight of about 51,000, PCZ-400 with a weight average molecular weight of about 40,000, PCZ-800 with a weight average molecular weight of about 80,000, and mixtures thereof. In embodiments of the present invention, it is desirable to select as coating solvents, ketones, alcohols, aromatic hydrocarbons, halogenated aliphatic hydrocarbons, ethers, amines, amides, esters, and the like; more specifically, there may be selected as solvents cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like; and yet more specifically tetrahydrofuran, (THF), monochlorobenzene, cyclohexanone, methylene chloride, and mixtures thereof.

An optional adhesive layer may be formed on the substrate. Typical materials employed as an undercoat adhesive layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometer to about 3 micrometers can be desirable. Optionally, the undercoat layer may contain suitable amounts of additives, for example, of from about 1 weight percent to about 10 weight percent of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Examples of photogenerating components, especially pigments, are metal free phthalocyanines, metal phthalocyanines, perylenes, vanadyl phthalocyanine, chloroindium phthalocyanine, and benzimidazole perylene, which is preferably a mixture of, for example, about 60/40, 50/50, 40/60, bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f') diisoquinoline-10,21-dione, chlorogallium phthalocyanines, hydroxygallium phthalocyanines, titanyl phthalocyanines, and the like, inclusive of appropriate known photogenerating components.

Charge transport components that may be selected are as illustrated herein like, for example, arylamines, and more specifically, N,N'-diphenyl-N,N-bis(3-methyl phenyl)-1,1'-biphenyl-4,4'-diamine, 9-9-bis(2-cyanoethyl)-2,7-bis(phenyl-m-tolylamino)fluorene, tritolylamine, hydrazone, N,N'-bis(3,4 dimethylphenyl)-N"(1-biphenyl) amine, and the like.

Specific examples of electron transport molecules are as illustrated herein like (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane, 1,3-dimethyl-10-(dicyanomethylene)-anthrone, and the like.

The photogenerating pigment can be present in various amounts, such as, for example, from about 0.05 weight percent to about 30 weight percent, and more specifically, from about 0.05 weight percent to about 5 weight percent. Charge transport components, such as hole transport molecules, can be present in various effective amounts, such as in an amount of from about 10 weight percent to about 75 weight percent, and more specifically, in an amount of from about 30 weight percent to about 50 weight percent; the electron transport molecule can be present in various amounts, such as in an amount of from about 10 weight percent to about 75 weight percent, and more specifically, in an amount of from about 5 weight percent to about 30 weight percent; and the polymer binder can be present in an amount of from about 10 weight percent to about 75 weight percent, and more specifically, in an amount of from about 30 weight percent to about 50 weight percent. The thickness of the single photogenerating layer can be, for example, from about 5 microns to about 70 microns, and more specifically, from about 15 microns to about 45 microns.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively charged, and the member can also be photodischarged.

The electron transporting materials can contribute to the ambipolar properties of the final photoreceptor and also provide the desired rheology and freedom from agglomeration during the preparation and application of the coating dispersion. Moreover, these electron transporting materials ensure substantial discharge of the photoreceptor during imagewise exposure to form the electrostatic latent image.

Polymer binder examples include components as illustrated, for example, in U.S. Pat. No. 3,121,006, the disclosure of which is totally incorporated herein by reference.

Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a molecular weight, $M_w$ of from about 50,000 to about 100,000 and the polymer binders, such as PCZ as illustrated herein.

The combined weight of the hole transport molecules and the electron transport molecules in the electrophotographic photoconductive insulating layer is between about 35 percent and about 65 percent by weight, based on the total weight of the electrophotographic photoconductive insulating layer after drying. The polymer binder can be present in an amount of from about 10 weight percent to about 75 weight percent, and preferably in an amount of from about 30 weight percent to about 60 weight percent, based on the total weight of the electrophotographic photoconductive insulating layer after drying. The hole transport and electron transport molecules are dissolved or molecularly dispersed in the binder. The expression "molecularly dispersed" refers, for example, to a dispersion on a molecular scale. The above materials can be processed into a dispersion useful for coating by any of the conventional methods used to prepare such materials. These methods include ball milling, media milling in both vertical or horizontal bead mills, paint shaking the materials with suitable grinding media, and the like to achieve a suitable dispersion.

Imaging members of the present invention are useful in various electrostatographic imaging and printing systems, particularly those conventionally known as xerographic processes. Specifically, the imaging members of the present invention are useful in xerographic imaging processes wherein the photogenerating component absorbs light of a wavelength of from about 550 to about 950 nanometers, and more specifically, from about 700 to about 850 nanometers. Moreover, the imaging members of the present invention can be selected for electronic printing processes with gallium arsenide diode lasers, light emitting diode (LED) arrays, which typically function at wavelengths of from about 660 to about 830 nanometers, and for color systems inclusive of color printers, such as those in communication with a computer. Thus, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

The following Examples are provided.

The XRPDs were determined as indicated herein, that is X-ray powder diffraction traces (XRPDs) were generated on a Philips X-Ray Powder Diffractometer Model 1710 using X-radiation of CuK-alpha wavelength (0.1542 nanometer).

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 5 to about 40 microns after drying.

EXAMPLE I

A pigment dispersion was prepared by roll milling 6.3 grams of Type V hydroxygallium phthalocyanine pigment particles and 6.3 grams of poly(4,4'-diphenyl-1,1'-cyclohexane carbonate) binder (PCZ200, available from Teijin Chemical, Ltd.) in 107.4 grams of tetrahydrofuran (THF) with several hundred, about 700 to 800 grams, of 3 millimeter diameter steel or yttrium zirconium balls for about 24 to 72 hours.

Separately, 2.04 grams of poly(4,4'-diphenyl-1,1'-cyclohexane carbonate) were weighed with 1.32 grams of tritolylamine, 0.88 gram of N,N'-bis(12-heptyl)-1,4,5,8-naphthalenetetracarboxylic diimide, 11.98 grams of THF, and 2.34 grams of monochlorobenzene. This mixture was rolled in a glass bottle until the solids were dissolved, then 1.44 grams of the above pigment dispersion were added to the dissolved solids to form a dispersion containing the Type V hydroxygallium phthalocyanine, poly(4,4'-diphenyl-1,1'-cyclohexane carbonate), tritolylamine, and N,N'-bis(2-heptyl)-1,4,5,8-naphthalenetetracarboxylic diimide in a solids weight ratio of (1.8:48.2:30:20) and a total solids content of 22 percent, and rolled to further mix (without milling beads). These dispersions were applied by dip coating to aluminum drums having a length of 24 to 36 centimeters, and a diameter of 30 millimeters. For the 22 weight percent dispersion, a pull rate of 110, and 160 millimeters/minute provided 25 and 30 micrometer thick single photoconductive insulating layers on the drums after drying. Thickness of the resulting dried layers were determined by capacitive measurement and by transmission electron microscopy.

EXAMPLE II

The processes of Example I were repeated except that N,N'-bis(3,4-dimethylphenyl)-4,4'-biphenyl amine, a hole transport molecule, was substituted for tritolylamine. This coating was applied to an aluminum drum as described in Example I.

EXAMPLE III

The above devices were electrically tested with a cyclic scanner set to obtain 100 charge-erase cycles immediately followed by an additional 100 cycles, sequences at 2 charge-erase cycles and 1 charge-expose-erase cycle, wherein the light intensity was incrementally increased with cycling to produce a photoinduced discharge curve from which the photosensitivity was measured. The scanner was equipped with a single wire corotron (5 centimeters wide) set to deposit 100 nanocoulombs/$cm^2$ of charge on the surface of the drum devices. The devices of Examples I and II were tested in the positive charging mode. The exposure light intensity was incrementally increased by means of regulating a series of neutral density filters, and the exposure wavelength was controlled by a bandfilter at 780±5 nanometers. The exposure light source was 1,000 watt Xenon arc lamp white light source. The dark discharge of the photoreceptor was measured by monitoring the surface potential for 14 seconds after a single charge cycle of 100 nanocoulombs/$cm^2$ (without erase).

The drum was rotated at a speed of 20 rpm to produce a surface speed of 8.3 inches/second or a cycle time of three seconds. The entire xerographic simulation was carried out in an environmentally controlled light tight chamber at ambient conditions (30 percent RH and 22° C.).

Photoinduced discharge characteristics (PIDC) of a 30 micrometer thick drum of Examples I and II showed initial photosensitivities, dV/dX, of ~408, 416 $Vcm^2$/ergs for positive charging modes with a residual voltage of 42, 32 V, respectively. The dark discharge was lower for Example II at 25 V/s compared to 26.4V/s for Example I. The device in Example II exhibits improved sensitivity reduced residual voltage and lower dark decay than the member of Example I.

EXAMPLE IV

The processes of Example II were repeated except that 1.54 grams of N,N'-bis-(3,4-dimethylphenyl)-4,4'-biphenyl amine were added in place of the tritolylamine and 0.66 gram of N,N'-bis(12-heptyl)-1,4,5,8-naphthalenetetracarboxylic diimide were used to prepare the final dispersion containing the Type V hydroxygallium phthalocyanine, poly (4,4'-diphenyl-1,1'-cyclohexane carbonate), N,N'-bis-(3,4-dimethylphenyl)-4,4'-biphenyl amine, and N,N'-bis(1,2-heptyl)-1,4,5,8-naphthalenetetracarboxylic diimide in a solids weight ratio of (1.8:48.2:35:15) and a total solid contents of 22 percent. This coating was applied to an aluminum drum as described in Example I.

This device showed a further reduction in dark discharge of 22 V/s. Replacing the hole transporter tritolylamine with N,N'-bis-(3,4-dimethylphenyl)-4,4'-biphenyl amine, and changing the relative ratio of hole and electron transporter is shown to decrease observed dark decay while maintaining the device performance.

EXAMPLE V

A pigment dispersion was prepared by roll milling 2.2 grams of x-polymorph metal free phthalocyanine pigment particles and 2.2 grams of poly(4,4'-diphenyl-1,1'-cyclohexane carbonate) (PCZ500 available from Teijin Chemical, Ltd.) in 35.6 grams of tetrahydrofuran (THF) with 300 grams of 3 millimeter diameter steel balls for about 1 to about 6 hours.

Separately, 2.04 grams of poly(4,4'-diphenyl-1,1'-cyclohexane carbonate) were weighed along with 1.32 grams of tritolylamine, 0.88 gram of 4-n-butoxycarbonyl-9-fluorenylidene malononitrile, 12 grams of THF and 2.34 grams of monochlorobenzene. This mixture was rolled in a glass bottle until the solids were dissolved, then 1.44 grams of the above pigment dispersion were added to form a dispersion containing the x polymorph of metal free phthalocyanine, poly(4,4'-diphenyl-1,1'-cyclohexane carbonate), tritolylamine, and 4-n-butoxycarbonyl-9-fluorenylidene malononitrile in a solids weight ratio of (1.8:48.2:30:20) and a total solid contents of 22 percent; and rolled to mix (without milling beads). These coatings were applied as described in Example I with the thicknesses noted.

EXAMPLE VI

The processes of Example VI were repeated except that 1.54 grams of tritolylamine and 0.66 gram of 4-n-butoxycarbonyl-9-fluorenylidene malononitrile were used to prepare the final dispersion containing the x-polymorph metal free phthalocyanine, poly(4,4'-diphenyl-1,1'-cyclohexane carbonate), tritolylamine of 4-n-butoxycarbonyl-9-fluorenylidene malononitrile in a solids weight ratio of (1.8:48.2:35:15) and a total solid contents of 22 percent. This coating was applied to an aluminum drum as described in Example I.

EXAMPLE VII

The processes of Example VI were repeated except that 1.10 grams of tritolylamine and 1.10 grams of 4-n-butoxycarbonyl-9-fluorenylidene malononitrile were used to prepare the final dispersion containing the x-polymorph metal free phthalocyanine, poly(4,4'-diphenyl-1,1'-cyclohexane carbonate), tritolylamine of 4-n-butoxycarbonyl-9-fluorenylidene malononitrile in a solids weight ratio of (1.8:48.2:25:25) and a total solid contents of 22 percent. This coating was applied to an aluminum drum as described in Example I.

EXAMPLE VIII

Photoinduced discharge characteristic (PIDC) curves at a positive charging mode of a 30 micrometer thick photoconductive drum of Examples V, VI and VII show initial photosensitivities, dV/dX, of 159, 190 and 128 V $cm^2$/ergs, and dark discharge rates of 20.2, 19.0 and 27.5 V/second, respectively. Replacing the electron transporter N,N'-bis(12-heptyl)-1,4,5,8-naphthalenetetracarboxylic diimide in Examples I, II and IV with 4-n-butoxycarbonyl-9-fluorenylidene malononitrile, and changing the weight ratio of hole transporter to electron transporter to 35:15 improves the sensitivity and lower dark decay with a x-polymorph metal free phthalocyanine.

The processes of Examples I, II and IV were repeated using N,N'-bis-(3,4-dimethylphenyl)-4,4'-biphenyl amine hole transporter and 4-n-butoxycarbonyl-9-fluorenylidene malononitrile electron transporter at the three specific weight ratios of 30:20, 35:15 and 40:10 with 1.8 weight percent Type V hydroxygallium phthalocyanine, 48.2 weight percent poly(4,4'-diphenyl-1,1'-cyclohexane carbonate), and a total solid contents of 22 weight percent. This coating solutions were applied to aluminum drums as described in Example I.

EXAMPLE IX

Photoinduced discharge characteristic (PIDC) curves at positive charging mode of 30 micrometer thick photoconductive drums of Example VI show decreasing dark decay as a function of increasing ratio of hole transporter to electron transporter; 36.2, 30, 29 V/second for the 30:20, 35:15 and 40:10 weight ratios, respectively. The effect of using both the N,N'-bis-(3,4-dimethylphenyl)-4,4'-biphenyl amine and the 4-n-butoxycarbonyl-9-fluorenylidene malononitrile also illustrates the desired lowering of the dark discharge Type V hydroxygallium phthalocyanine. This set of materials in the 40:10 ratio significantly reduces the dark decay with Type V hydroxygallium phthalocyanine.

EXAMPLE X

The processes of Examples I, II and IV were repeated using N,N'-bis-(3,4-dimethylphenyl)-4,4'-biphenyl amine hole transporter and a variety of electron transport materials, and more specifically, 2-EHCFM, BIB-CNs at the three specific weight ratios of 30:20, 35:15 and 40:10 with 1.8 weight percent Type V hydroxygallium phthalocyanine, 48.2 weight percent poly(4,4'-diphenyl-1,1'-cyclohexane carbonate), and a total solid contents of 22 weight percent. These coating solutions were applied to aluminum drums as described in Example I and electrically tested as in Example II. The results are shown in the table below for the electron transport material (ETM), in various weight ratios with the hole transport material (HTM:ETM).

| ETM | HTM:ETM Ratio | dV/dX ($Vcm^2/erg$) | Dark Discharge (V/s) |
|---|---|---|---|
| 2EHCFM | 25:25 | 316.2 | 25 |
| | 30:20 | 350.9 | 33 |
| | 40:10 | 363.7 | 29 |
| 1. BIBCN/Nbutyl | 25:25 | 362.6 | 30.7 |
| | 30:20 | 348 | 27.2 |
| | 40:10 | 396 | 36 |
| 2. Isobutyl | 25:25 | 318 | 32.2 |
| | 30:20 | 410.8 | 35.95 |
| | 40:10 | 401.5 | 36.99 |
| 3. Sec butyl | 25:25 | 350.44 | 29.9 |
| | 30:20 | 387.3 | 36.0 |
| | 40:10 | 406.3 | 39.2 |

For the 2EHCFM material, the 40:10 weight ratio provided an excellent formulation enabling, for example, maximum sensitivity while lowering the dark discharge, while for the BICN class of compounds di(n-butyl) benzophenone bisimide, bis(isobutyl) benzophenone bisimide, bis(sec-butyl) benzophenone bisimide, the 30:20 weight ratio is also excellent for a number of characteristics.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a supporting substrate, and thereover a single layer comprised of a mixture of a photogenerator component, a charge transport component, an electron transport component, and a polymer binder, and wherein the charge transport component is selected from the group consisting of N,N'-bis-(3,4-dimethylphenyl)-4-biphenyl amine; N,N'-bis-(4-methylphenyl)-N,N'-bis-(4-ethylphenyl)-1,1',3,3'-dimethylbiphenyl)-4,4'-diamine; N,N'-diphenyl-N,N'-bis(alkylphenyl)-1,1'-biphenyl-4,4'-diamine; and tri-p-tolylamine; and wherein the electron transport component is N—$R_1$—N'—$R_2$-1,4,5,8-naphthalenetetracarboxylic diimide represented by the formula

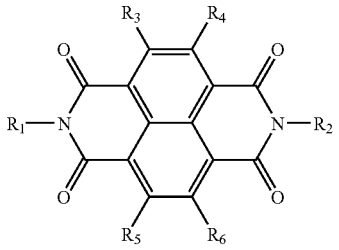

wherein $R_1$ is methyl, ethoxy, propoxy, cycloalkyl, or halide; $R_2$ is methyl, ethoxy, propoxy, or cycloalkyl; and $R_3$, $R_4$, $R_5$ and $R_6$ are independently selected from the group consisting of methyl, cycloalkyl, ethoxy, propoxy, phenyl, naphthyl, anthryl, and halogen.

2. An imaging member in accordance with claim 1 wherein said single layer is of a thickness of from about 5 to about 60 microns.

3. An imaging member in accordance with claim 1 wherein the amount for each of said components in said single layer is from about 0.05 weight percent to about 30 weight percent for the photogenerating component; from about 10 weight percent to about 75 weight percent for the charge transport component, and from about 10 weight percent to about 75 weight percent for the electron transport component; and wherein the total of said components is about 100 percent; and wherein said layer components are dispersed in from about 10 weight percent to about 75 weight percent of said polymer binder; and optionally wherein said layer is of a thickness of from about 15 to about 40 microns.

4. An imaging member in accordance with claim 1 wherein the amount for each of said components in the single layer mixture is from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder.

5. An imaging member in accordance with claim 1 wherein the thickness of said layer is from about 5 to about 35 microns.

6. An imaging member in accordance with claim 1 wherein said binder is present in an amount of from about 50 to about 90 percent by weight, and wherein the total of all components of said photogenerating component, said charge transport component, said binder, and said electron transport component is about 100 percent.

7. An imaging member in accordance with claim 1 wherein the binder is selected from the group consisting of polyesters, polyvinyl butyrals, polycarbonates, polystyrene-b-polyvinyl pyridines, and polyvinyl formals.

8. An imaging member in accordance with claim 1 wherein said photogenerating component absorbs light of a wavelength of from about 370 to about 950 nanometers.

9. An imaging member in accordance with claim 1 wherein the supporting substrate is comprised of a conductive substrate comprised of a metal.

10. An imaging member in accordance with claim 9 wherein the conductive substrate is aluminum, aluminized polyethylene terephthalate or titanized polyethylene terephthalate.

11. An imaging member in accordance with claim 1 wherein said charge transporting component comprises

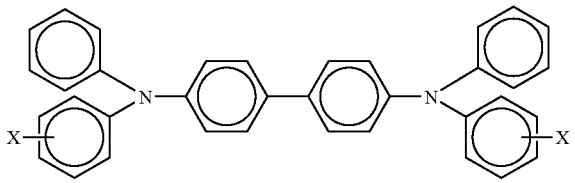

wherein X is alkyl containing from 1 to about 10 carbon atoms.

12. An imaging member in accordance with claim 11 wherein alkyl contains from 1 to about 5 carbon atoms.

13. An imaging member in accordance with claim 1 wherein said charge transport component is N,N'-diphenyl-N,N-bis(3-methyl phenyl)-1,1'-biphenyl-4,4'-diamine.

14. An imaging member in accordance with claim 1 wherein said binder is a film forming polymeric binder.

15. An imaging member in accordance with claim 1 wherein said photogenerator component is a phthalocyanine possessing major peaks, as measured with an X-ray diffractometer, at Bragg angles (2 theta+/−0.2°).

16. An imaging member in accordance with claim 1 wherein said photogenerator component is a chlorogallium phthalocyanine, or a hydroxygallium phthalocyanine.

17. An imaging member in accordance with claim 1 wherein said binder is a polycarbonate optionally with a weight average molecular weight of from about 500 to about 80,000.

18. An imaging member in accordance with claim 1 wherein said photogenerator component is present in an amount of from about 1 to about 3 weight percent; said charge transport component is present in an amount of from about 25 to about 40 weight percent; said electron transport component is present in an amount of from about 10 to about 20 weight percent; said binder is present in an amount of from about 40 to about 60 weight percent; and wherein the total of said components is about 100 percent.

19. An imaging member in accordance with claim 1 wherein said photogenerator component is present in an amount of from about 1 to about 3 weight percent; said charge transport component is present in an amount of from about 35 to about 40 weight percent; said electron transport component is present in an amount of from about 10 to about 15 weight percent; said binder is present in an amount of from about 47 to about 50 weight percent; and wherein the total of said components is about 100 percent; and wherein said layer is of a thickness of from about 15 to about 40 microns.

20. An imaging member in accordance with claim 1 further containing an adhesive layer and a hole blocking layer.

21. An imaging member in accordance with claim 20 wherein said blocking layer is contained as a coating on a substrate, and wherein said adhesive layer is coated on said blocking layer.

22. An imaging member in accordance with claim 1 wherein said binder is a polycarbonate, polystyrene-b-polyvinyl pyridine.

23. A photoconductive imaging member comprised of a supporting substrate, and thereover a single layer comprised of a mixture of a photogenerator component, a charge transport component, an electron transport component, and wherein the charge transport component is selected from the group consisting of N,N'-bis-(3,4-dimethylphenyl)-4-biphenyl amine; N,N'-bis-(4-methylphenyl)-N,N'-bis-(4-ethylphenyl)-1,1',3,3'-dimethylbiphenyl)-4,4'-diamine; and N,N'-diphenyl-N,N'-bis(alkylphenyl)-1,1-biphenyl-4,4'-diamine, and wherein said electron transport component is a N—$R_1$—N'—$R_2$-1,4,5,8-naphthalenetetracarboxylic diimide represented by the formula

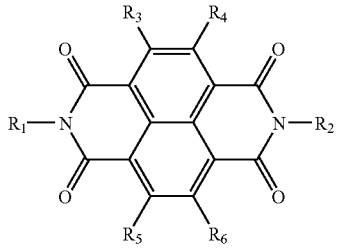

wherein $R_1$ is methyl, ethoxy, propoxy, or chloride; $R_2$ is methyl, ethoxy, propoxy, or cycloalkyl; and $R_3$ to $R_6$ are independently selected from the group consisting of methyl, ethoxy, propoxy, cycloalkyl, chloride, or phenyl.

24. A photoconductive imaging member comprised of a supporting substrate, and thereover a single layer comprised of a mixture of a photogenerator component, a chargetransport component, an electron transport component, and wherein the charge transport component is selected from the group consisting of N,N'-bis-(3,4-dimethylphenyl)-4-biphenyl amine; N,N'-bis-(4-methylphenyl)-N,N'-bis-(4-ethylphenyl)-1,1',3,3'-dimethylbiphenyl)-4,4'-diamine; and N,N'-diphenyl-N,N'-bis(alkylphenyl)-1,1-biphenyl-4,4'-diamine, and wherein said electron transport component is a N—$R_1$—N'—$R_2$-1,4,5,8-naphthalenetetracarboxylic diimide represented by the formula

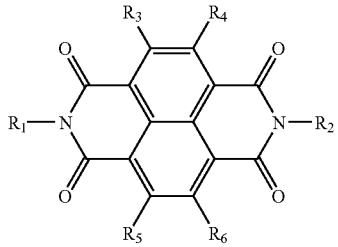

wherein $R_1$ is methyl, ethyl, ethoxy, propoxy, cycloalkyl, or chloride; $R_2$ is methyl, ethoxy, propoxy, or cycloalkyl; and $R_3$ to $R_6$ are independently selected from the group consisting of methyl, ethyl, ethoxy, propoxy, cycloalkyl, chloride, phenyl, or naphthyl.

25. A method of imaging which comprises generating an electrostatic latent image on the imaging member of claim 1, developing the latent image, and transferring the developed electrostatic image to a suitable substrate.

* * * * *